US006752352B1

(12) United States Patent
May et al.

(10) Patent No.: US 6,752,352 B1
(45) Date of Patent: Jun. 22, 2004

(54) GUN-LAUNCHED ROLLING PROJECTILE ACTUATOR

(76) Inventors: Michael C. May, 1708 Saddle Draw, Healdsburg, CA (US) 95448; Richard W. Schroeder, 252 Lorraine Ct., Healdsburg, CA (US) 95448; Allan A. Voigt, 400 Breezewood Dr., Geyserville, CA (US) 95441; John M. Speicher, 133 Rossi Rd., Geyserville, CA (US) 95441; Che-Ram S. Voigt, 400 Breezewood Dr., Geyserville, CA (US) 95441

( * ) Notice: Subject to any disclaimer, the term of this patent is extended or adjusted under 35 U.S.C. 154(b) by 0 days.

(21) Appl. No.: 10/616,337

(22) Filed: Jul. 7, 2003

(51) Int. Cl.[7] ..... F42B 10/64
(52) U.S. Cl. ..... 244/3.24; 244/3.27; 244/75 R
(58) Field of Search ..... 244/3.24–3.29, 244/75 R; 74/424.8, 89.19

(56) References Cited

U.S. PATENT DOCUMENTS 3,911,847 A * 10/1975 Worthing ..... 114/150
5,255,882 A * 10/1993 Schroppel ..... 244/3.24
6,073,880 A * 6/2000 Voigt et al. ..... 244/3.28
6,247,666 B1 * 6/2001 Baker et al. ..... 244/3.21

* cited by examiner

*Primary Examiner*—Galen Barefoot
(74) *Attorney, Agent, or Firm*—Hunton & Williams

(57) ABSTRACT

An actuator system for controlling the external fins on a gun-launched projectile to control the flight path of the projectile. These actuator systems include an electric motor having a rotor and output shaft which is driven between travel limits that are less than 180 apart (less than 90 in either direction from a central rest position). Coupling from the motor shaft to the control shaft for the external fins is via a coupling between an eccentric ball on the motor shaft and an eccentric receptacle member on the fin shaft. As the angle of the motor shaft varies, the eccentric ball slides in a slot in the fin coupling member, causing the fin shaft angle to vary correspondingly. In another embodiment, the eccentric ball for controlling the fin shaft angle is mounted on a link arm that is coupled to the motor shaft, thereby permitting the motor to be mounted off the projectile axis and thus accommodating a shortened space in the projectile required for the actuator system and associated power supply.

18 Claims, 8 Drawing Sheets

MOTOR @ 60°

MOTOR @ 0°

MOTOR @ 0°

MOTOR @ 60°

MOTOR @ 60°

MOTOR @ -60°

MOTOR @ -60°

MOTOR @ 0°

MOTOR @ 60°

MOTOR @ -60°

MOTOR @ 0°

MOTOR @ 0°

MOTOR @ 60°

MOTOR @ 60°

MOTOR @ -60°

MOTOR @ -60°

GUN-LAUNCHED ROLLING PROJECTILE ACTUATOR

BACKGROUND OF THE INVENTION

1. Field of the Invention

The present invention generally relates to fin control systems for gun-launched projectiles and, more particularly, to the actuators and associated linkages for controlling the angle of the aerodynamic control fins which impart steering forces to the projectile during flight.

2. Description of the Related Art

Presently existing actuators for fin control on gun-launched projectiles are both complex and expensive. The requirement to withstand the acceleration forces, which typically range from 10,000 to 30,000 G's, places very stringent demands on the actuators. Therefore, the designs are required to be extremely robust in order to withstand the loads induced by these accelerations.

It is an object of this invention to provide a simple but effective configuration which is simple in structure but which is also low cost to produce and extremely robust. It is particularly capable of withstanding extreme accelerations.

At present, existing actuators for fin control on gun-launched projectiles typically employ electric motors to drive the fins through a gear reduction system. These motors are either brush or brushless types that make several revolutions of the motor while moving the fin from one travel limit to the other. In the case of the brush type motors, there are substantial reliability issues with the brush systems due to the high acceleration loads and problems with corrosion resulting from long-term storage. The brushless types have reliability issues with rotor position sensing complexity.

There are typically two basic configurations of gun hardened projectile actuators: (1) the motor on the central axis, and (2) the motor off the central axis to allow the fins to be folded adjacent to the motor. The design of the present invention addresses both configurations. This design is applicable to projectiles in which the fins are stowed internally and extended to effect steering control after the projectile is fired. The design is also applicable in those configurations in which the fins are not folded because they are small or short enough to fit in the gun barrel. Also, it is appropriate for projectiles where a sabot is used to adapt a projectile with external fins to the dimensions of the gun barrel, wherein the sabot opens up and peels away after the projectile leaves the muzzle.

Systems of the present invention comprise as the motive element a limited rotation motor, the shaft of which rotates through less than half a revolution in driving the fin from one travel limit to another. These limited rotation motors lend themselves to low cost manufacturing techniques. There is no requirement for secondary electronics to sense the motor commutation steps. Cost is reduced by not having to commutate the motor over its rotation. Prior art systems utilizing brushless motors operating over several revolutions require Hall effect sensors or some other means of sensing rotor position to switch phases. A brush-type motor would require brushes and a commutator. Either approach introduces added cost over what is required in the design of the present invention.

Limited rotation motors of the type used herein may be either a moving magnet type or a variable reluctance type wherein the rotor reluctance is used to torque the motor in the external armature field. Because the variable reluctance approach does not use permanent magnets, it has a potential for lower cost. Either of these types of motors is relatively cheap to manufacture. Either can be machine wound automatically so very little handwork is required. Also, each design is very robust and can be hardened for gun launching. In either case the inherent simplicity of the design makes for high reliability. This design also provides benefits in the case where a more conventional motor of either brush or brushless type is used. This is because, among other reasons, as the loads increase with increase of fin angle, the reduction ratio between the motor and the output shaft increases. This reduces the power needed to provide the required torque at the output shaft.

The relatively low reduction ratio between the motor and the fin shaft of the instant design is well suited to rapidly rolling airframes, for example up to a 30 Hz roll rate. This is because rolling airframes require fin deflections that follow the projectile roll without significant phase error. This allows maneuvering in a single plane without inducing spiraling. Thus, it is a feature of the present invention design that it is well suited to applications with rolling airframes.

Furthermore, there is potential for energy conservation in these rolling airframe applications because the aerodynamic induced torque applied to the control fin can be used to decelerate and re-accelerate the motor, thus recovering some of the electrical energy that was input to the motor. The degree and effectiveness of this energy recovery depends on several factors, among which are the motor and mechanical drive characteristics, the electronic driver, and the battery or other power source.

The change in the reduction ratio between the motor and the fin shaft as the angle of the fin increases comes about because the ratio from motor to fin shaft varies as the sine of motor shaft position divided by the sine of the fin shaft position. Since the motor shaft angular displacement is a multiple of the displacement of the fin shaft, the effective ratio increases as a function of displacement. Thus, the maximum ratio occurs at the extremes of travel where the aerodynamic load is greatest. This feature permits minimization of the motor size because of the inherent torque increase for maximum load.

Comparison of the cost of the embodiments of the present invention with known prior art arrangements is extremely favorable for the present invention. The simplest way to look at cost is to compare part count and complexity. The simple ball and crank pin and eccentric slotted coupling for the fin shaft are much lower cost than any gear or screw drives. These features are also much lower cost than precision bearing bores for gears.

SUMMARY OF THE INVENTION

In brief, particular arrangements in accordance with the present invention comprise a brushless motor having an output shaft which is controlled to rotate less than 90° from either side of a rest position. The end of the motor shaft has a crank arm that is offset by a prescribed distance with a ball end machined on the end of the crank. In an alternative arrangement, a ball is mounted to the motor shaft by an eccentric pin. As the motor rotates, the ball slides in a slot in the fin shaft which is perpendicular to the motor axis. The ball and slot are at a radius of about one-half the prescribed offset distance, resulting in a motor-to-fin ratio of about 6:1. This sliding ball-and-slot coupling of the motor shaft to the fin shaft is a major feature of the present invention, since it takes advantage of the limited rotation of the fin shaft to eliminate the need for any gears or screw drives. Contact is maintained with the ball in the shaft slot as the shaft moves through its arc by allowing the ball to slide axially by a limited amount in the slot. The ball-to-slot interface is a tight slip fit. This arrangement results in a very high overall efficiency of the drive coupling, on the order of 90%.

In one particular arrangement of the present invention, the motor is mounted along the center line of the projectile, and engages the fin shaft through a right-angle mounted eccentric coupler.

In an alternative embodiment of the present invention, the motor is displaced from the projectile axis. The motor shaft is coupled to the output shaft by a link arm which permits the motor to be folded back into the projectile interior space, which also includes the battery envelope, thereby allowing use of the same motor and electronics of the other embodiment while further reducing total package length. In all cases, the design of the present invention allows for a very compact actuator drive package.

BRIEF DESCRIPTION OF THE DRAWINGS

A better understanding of the present invention may be realized from a consideration of the following detailed description, taken in conjunction with the accompanying drawings, in which:

FIGS. 7A–7C and 8A–8C are shown in respective correspondence on three separate sheets of drawing so that the movement of the motor link arm and fin shaft for the three different angular positions which are displayed may be more readily apparent.

DESCRIPTION OF THE PREFERRED EMBODIMENTS

In the accompanying drawings, FIGS. 1–6C show various details of an on-axis motor design in accordance with the present invention.

Figure 1:
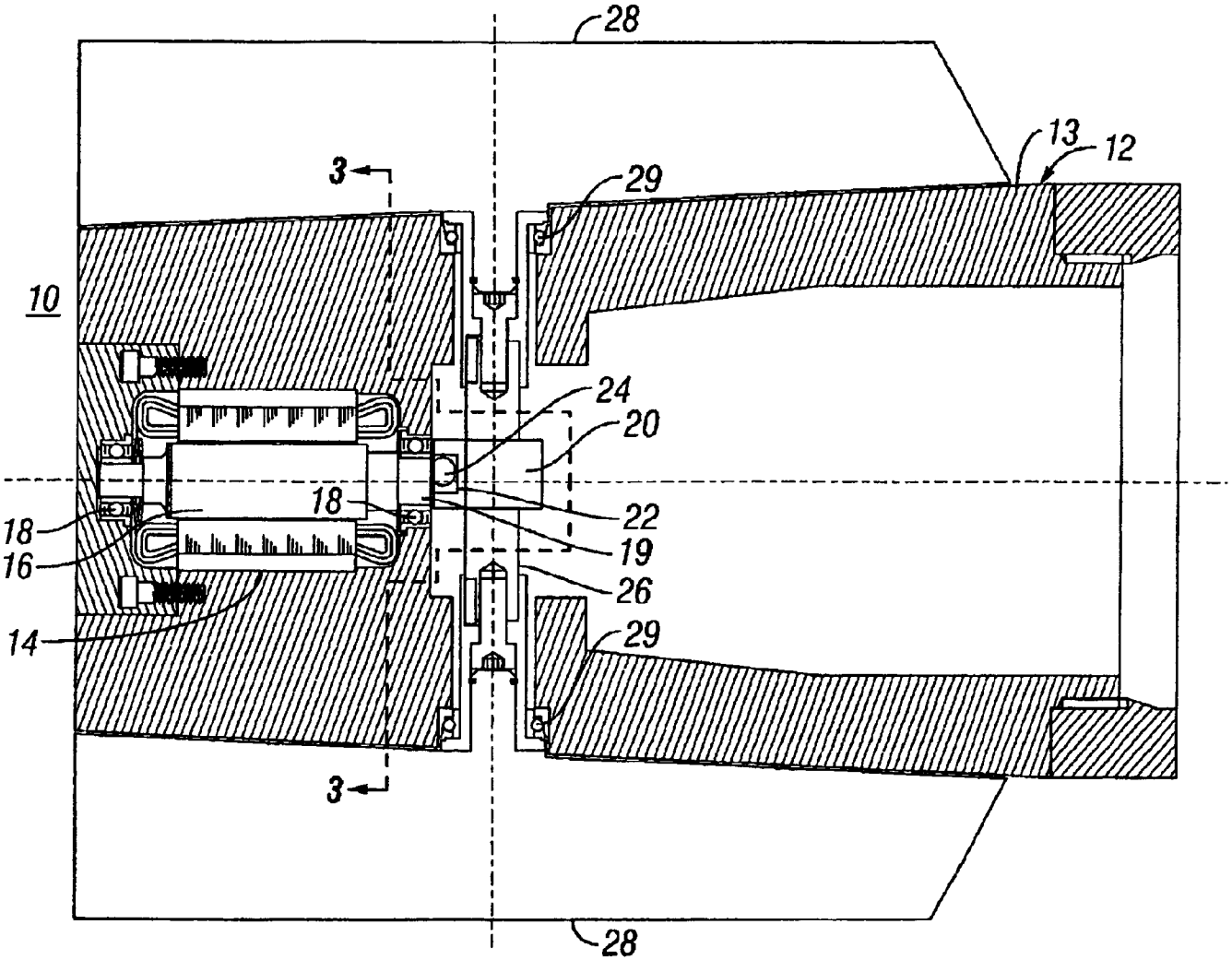
FIG. 1 is a schematic sectional side view, partially broken away, of a portion of a projectile containing one particular arrangement of the invention.
Figure 2:
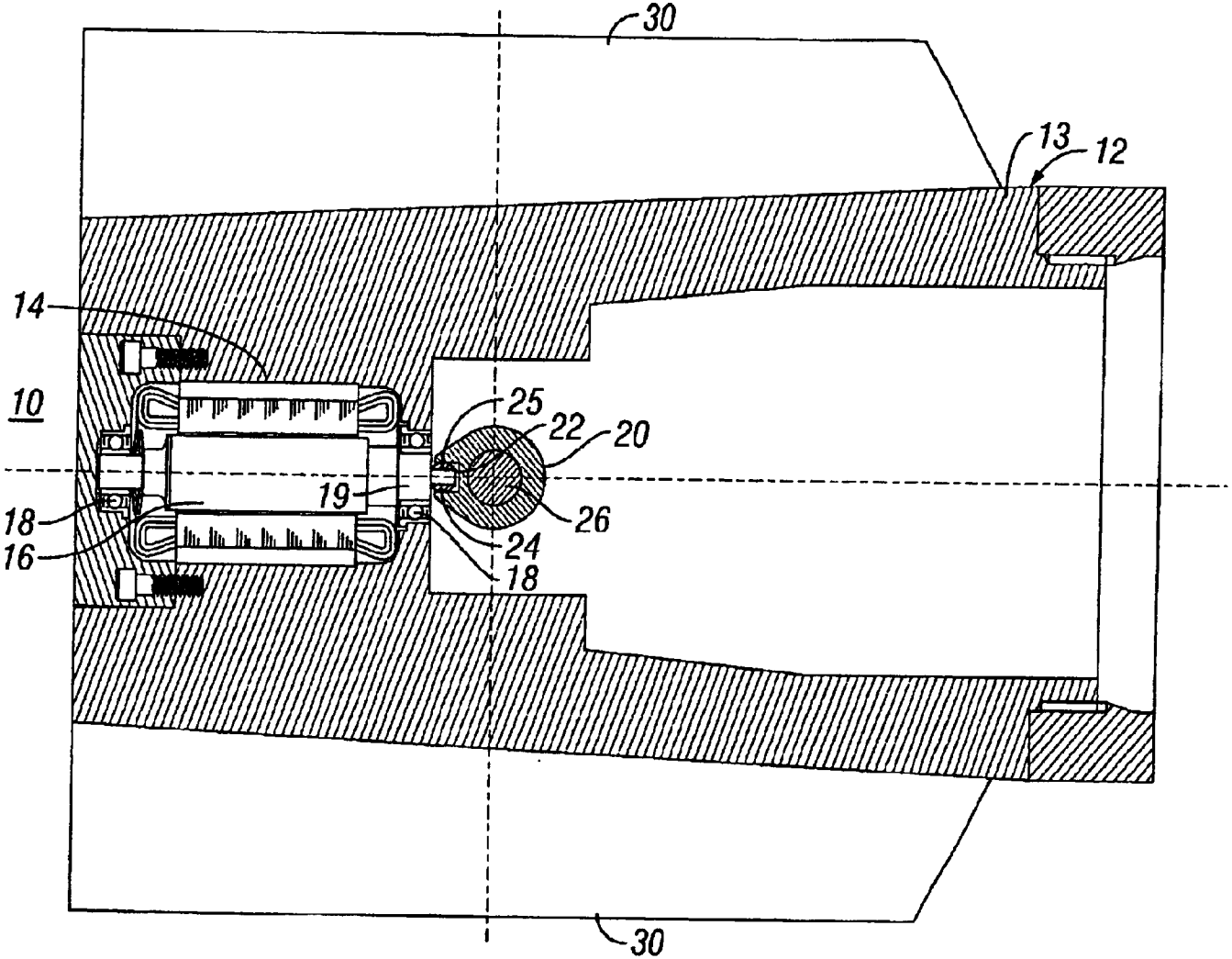
FIG. 2 is a schematic side sectional view of the arrangement of FIG. 1, the section being oriented at 90° from the sectional view of FIG. 1.
Figure 3:
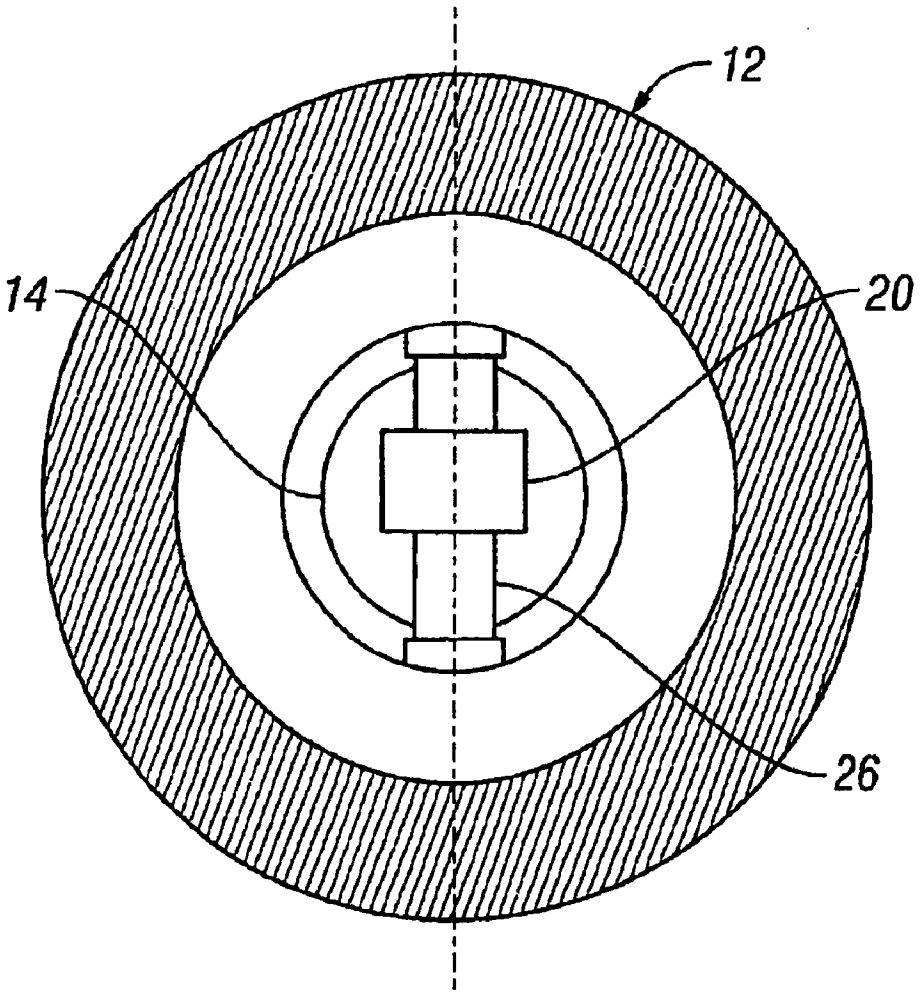
FIG. 3 is a schematic transverse sectional view of the central portion of the arrangement of FIG. 1, taken along the broken line 3—3.

FIGS. 1, 2 and 3 are respective orthogonal sectional views of the on-axis embodiment. For the sake of reference, the view of FIG. 1 may be considered a vertical section; the view of FIG. 2 would therefore be a horizontal section; the view of FIG. 3 is a side or end section. The direction of projectile flight is from left to right.

In the three orthogonal views (FIGS. 1, 2 and 3), of the gun-launched rolling projectile actuator 10, the projectile 12 is shown with housing 13 containing a motor 14 having a rotor 16 with its shaft mounted in end bearings 18. External steering fins 28 (shown in FIG. 1) are attached to a fin shaft 26 having a fin drive member, or coupler, 20 installed on the shaft 26. Fins 28 are mounted in bearings 29 to permit rotation about the shaft 26. The coupler 20 is provided with a slot 22 positioned to engage a ball 24 which is eccentrically mounted on the end of the motor output shaft 19 by means of a pin 25 (FIG. 2). FIG. 2 also shows a fixed pair of fins 30 on opposite sides of the projectile 12.

The motor rotor 16 is constrained by the structural configuration of the actuator to rotate over an angle less than 180°. This means that the rotor rotates less than 90° in either direction from a central rest position. In the specific embodiment disclosed herein, that rotation or angular displacement is within a limit of 60° from the central rest position.

Figure 4A:
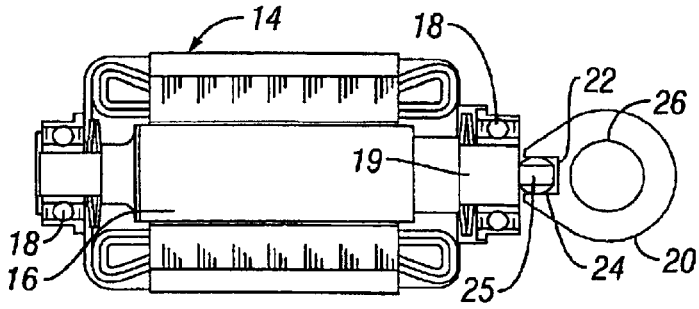
FIGS. 4A, 4B and 4C are schematic side sectional views showing the motor shaft-fin shaft coupling arrangement in various displacement positions.
Figure 5A:
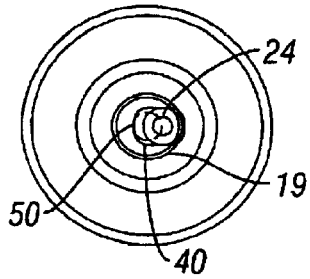
FIGS. 5A, 5B and 5C are schematic displays showing transverse views of the arrangements of FIGS. 4A–4C, positioned in respective correspondence therewith.
Figure 4B:
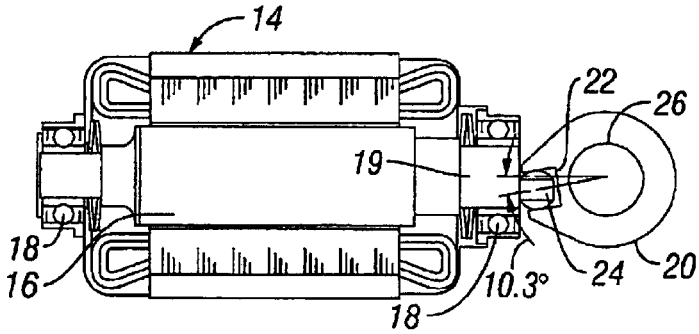
Figure 5B:
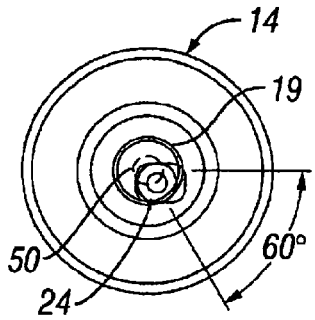
Figure 4C:
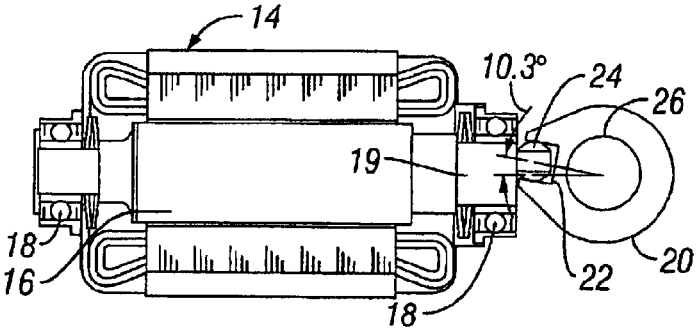
Figure 5C:
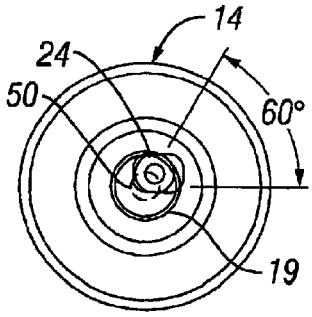
Figure 6A:
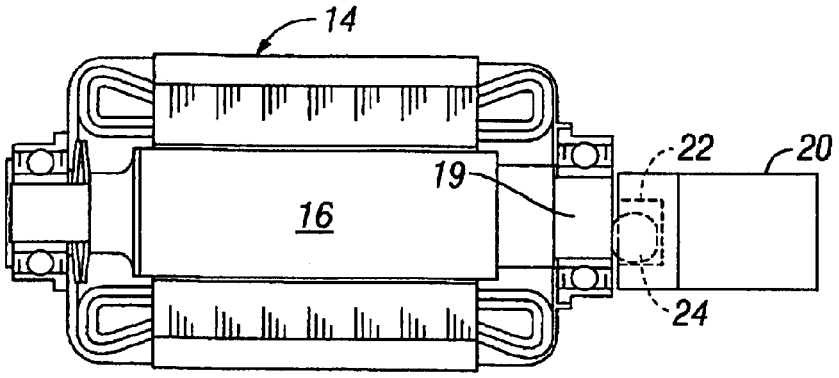
FIGS. 6A, 6B and 6C are schematic sectional views, orthogonal to corresponding views of FIGS. 4A, 4B and 4C and partially cut away to show axial movement of the shaft coupling member for various angular displacements.
Figure 6B:
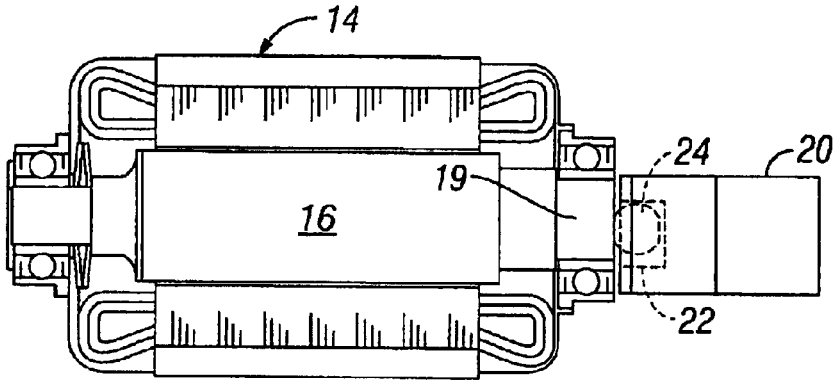
Figure 6C:
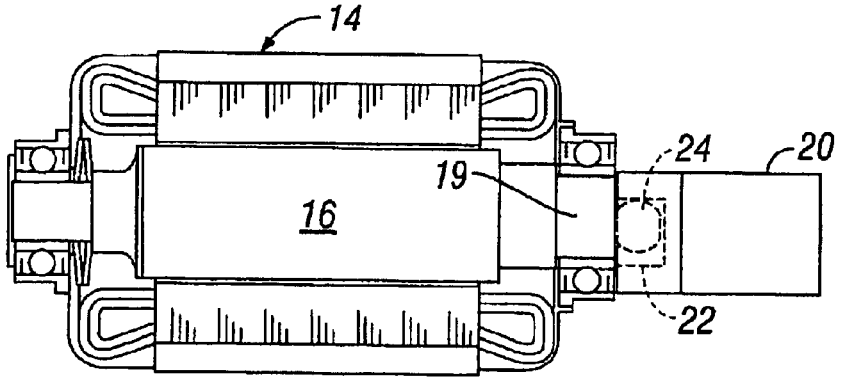

This action may perhaps be better explained with reference to FIGS. 4A–4C, 5A–5C and 6A–6C. FIGS. 4A–4C correspond in orientation to FIG. 2. FIGS. 6A–6C correspond to FIG. 1. FIGS. 5A–5C are schematic end views of FIGS. 4A–4C, respectively, with the shaft 26 and coupler 20 removed.

The same reference numbers are used in these figures for the elements depicted in FIGS. 1 and 2. In addition, additional geometric elements are shown in FIGS. 5A–5C wherein the small circle 50 includes the arc which is the path of the center of the ball 24 during its travel. The dimensions of certain distances are provided in the drawings for one example of movement of the actuator elements. In this example, the distance between the center of the shaft 26 and the center of the ball 24 is 0.33 inches. The circle 50 has a diameter of 0.12 inches. The diameter of shaft 19 is 0.25 inches. As the ball 24 with its end shaft 19 rotates through an angle of 60° in either direction from the rest position shown in FIGS. 4A, 5A and 6A, the shaft 26 with coupler 20 is caused to rotate through an angle of 10.3°. This results in a vertical displacement of the ball 24 by 0.05 inches. This vertical displacement (in the direction of the output shaft 26) must be accommodated by the coupler 20. This is taken care of by providing the slot 22 with vertical clearance which permits the ball to move up and down (in the direction of the shaft 26) within the slot 22. This is particularly illustrated in the views of FIGS. 6A–6C.

Since the motor shaft with ball 24 rotates through an angle of 60° in causing rotation of the fin shaft 26 with coupler 20 through an angle of about 10°, the ratio of reduction is 60 divided by 10 or 6:1. This ratio varies in a favorable way with the extent of the rotation as the load to drive the fin increases. For maximum angular displacement of the fin, the effective ratio between the motor and the fin shaft also increases. This helps reduce the maximum torque which is required from the motor. For example, if the linkage geometry is set to provide 10° of output rotation at 60° of motor rotation (as in the example of FIGS. 4A–4C), then the ratio of motor rotation to output rotation at the center of travel is about 5:1. However, when the motor is at maximum 60° rotation, the ratio of motor rotation to output rotation has increased to about 15:1 in the particular embodiment disclosed herein.

As noted, the reduction ratio varies over the displacement angle in a manner which reduces the load on the motor as the aerodynamic forces on the fins (and fin shaft) increase with increased deflection. The relationship producing this result may be expressed as:

$$\text{Reduction Ratio}=R_f/R_M \times \text{Cos}\ \Theta_f/\text{COS}\ \Theta_M \quad (1)$$

where $R_f$ is the effective radius of the fin shaft (distance between centers of the fin shaft and the ball);

$R_M$ is the effective radius of the motor shaft (the distance from the center of the ball to the axis);

$\Theta_f$ is the displacement angle of the fin shaft (varying from 0° to 10.3°); and $\Theta_M$ is the displacement angle of the motor shaft from the center position (varying from 0° to 60°).

The increase in the reduction ratio with increasing displacement angle can be readily understood from the perception that the angle of motor shaft displacement is greater (60°) than the angle of the fin shaft displacement (approximately 10°). The fraction of the two cosine functions increases as the denominator becomes smaller more rapidly than the numerator.

It will be appreciated by those of ordinary skill in the art that, because there are different ways in which the arrangement of the present invention can be implemented, a single mathematical relation does not hold for every different case. Nevertheless, there are certain relationships which generally apply. These include the following:

The motion of the eccentric ball 24 on the motor shaft 19 starts in the center position with the fins in the zero angle-of-attack position. The rotation of the motor shaft from this center position in either direction applies motion to the fin shaft 26 through the eccentric coupler 20.

The motion of the output shaft (fin shaft) 26 is related to the motion of the motor shaft 19 in such a way that as the angle of rotation of the motor moves from the zero position, the induced resulting incremental motion of the output shaft gradually reduces, in a sinusoidal fashion, with respect to motor shaft angle. The extent of motion of the output shaft for an incremental extent of motor rotation is maximum at zero motor shaft angle. This means that the reduction ratio of the drive is at a minimum at the center of travel.

As the eccentric ball on the motor shaft moves away from its center or zero position, the linkage motion induced on the output shaft gradually reduces in a sinusoidal fashion. I.e., at greater displacement angles, incremental displacement of the output shaft is less for a given increment of rotation of the motor shaft. Consequently, the instantaneous reduction ratio increases with increasing deflection angle. At the maximum permitted motor rotation, the instantaneous reduction ratio is greatest. This is advantageous, because the aerodynamic loads are usually greatest at the travel limit.

An alternative embodiment of the invention is shown in FIGS. 7 and 8 wherein like elements of the first embodiment are designated with the same reference numerals plus 100. The embodiment of FIGS. 7 and 8 is an off-axis motor installation with provision made to permit the actuator system to be folded back on itself. The motor and battery power supply can therefore be installed in a shorter space.

The second embodiment of the actuator system 110 is shown comprising a motor 114 within projectile housing 113 which has a rotor 116 with end shafts 119 mounted in rotary bearings 118. An orthogonally mounted fin shaft 126 is mounted for rotation within fin bearings 129. A link arm 160 extends between an eccentrically-mounted ball 164 on the motor shaft and a ball 166 at the fin shaft end of the link arm. The fin shaft 126 is provided with a cut-out 162 to provide clearance for the motor 114. The link arm moves longitudinally within a link arm channel 168 when the motor 114 is activated to drive the link arm and fin shaft. A fin coupler 170 is provided to effectuate rotation of the fin shaft. A pair of Belleville washers 172 are mounted near the ends of the rotor 116 to hold the motor bearings 118 in place. These are designed to collapse under load, thereby releasing pressure on the bearings 118. A battery 174 is mounted in a battery envelope on the other side of the projectile from the motor 114.

Figure 8A:
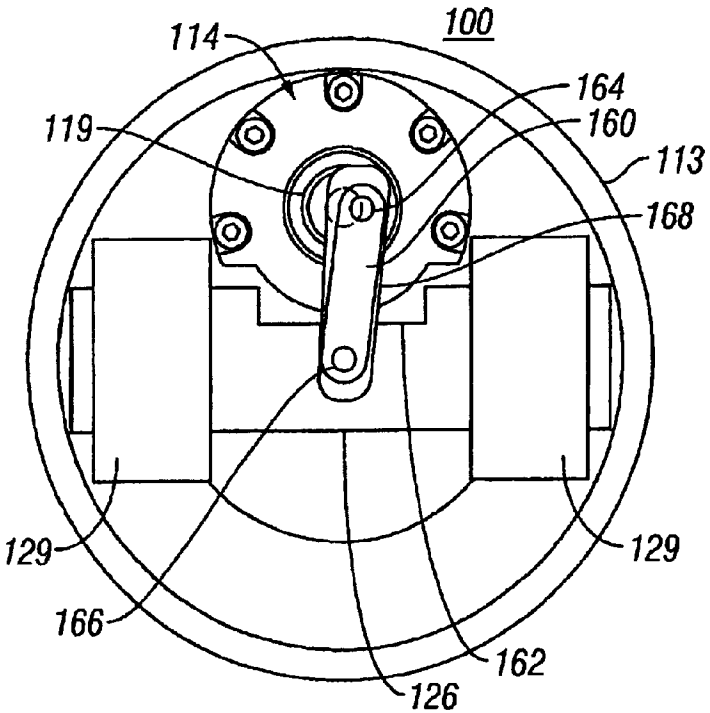
FIGS. 7A and 8A are schematic views, taken as a side section and an end view, respectively, showing an off-axis motor design of a second particular arrangement of the invention.
Figure 7A:
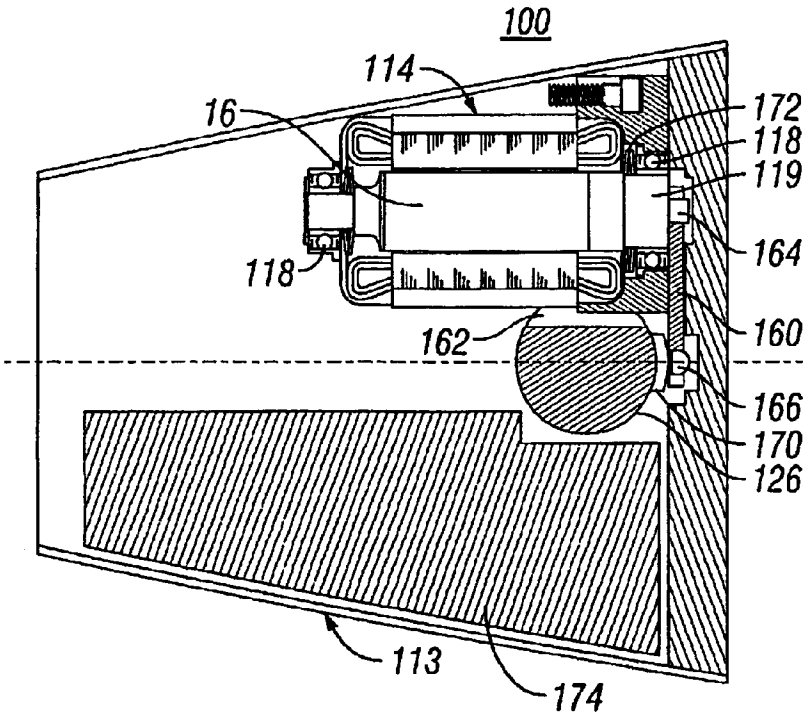
Figure 8B:
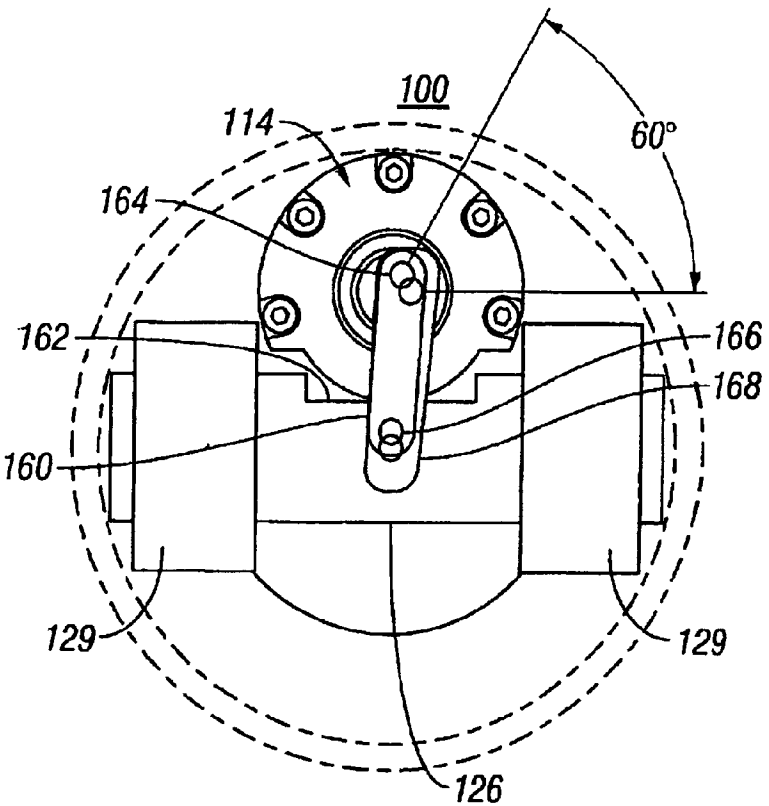
FIGS. 7B and 8B are schematic views, taken as a side section and an end view, respectively, showing the off-axis motor design in a different angular position.
Figure 7B:
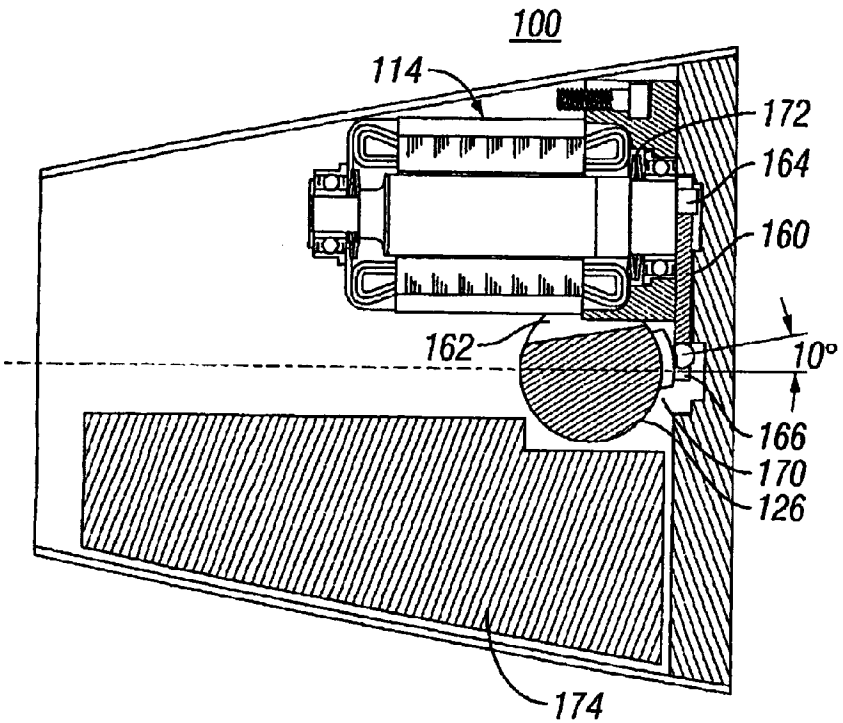
Figure 8C:
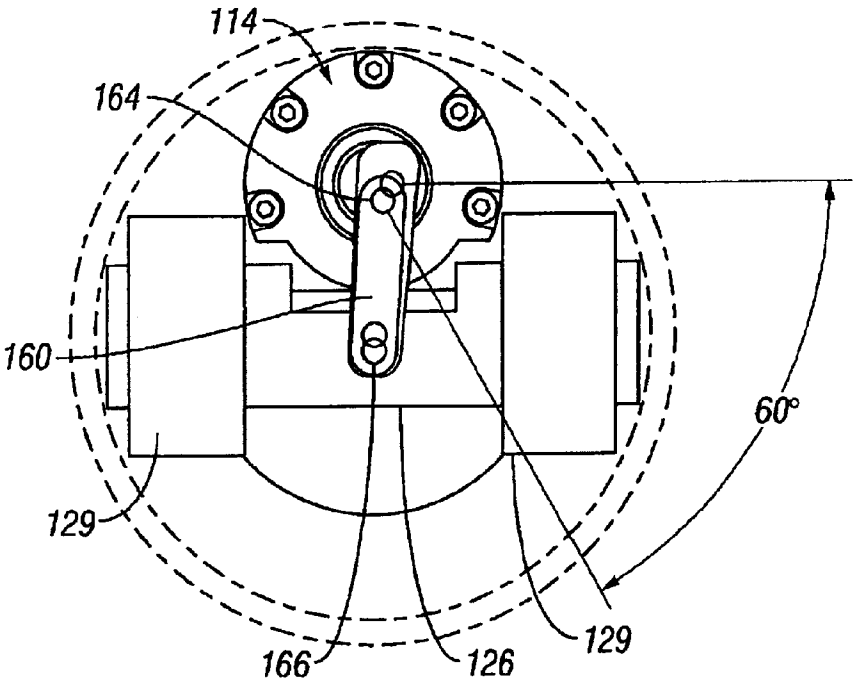
FIGS. 7C and 8C are schematic views, taken as a side section and an end view, respectively, showing the off-axis motor in still another angular position.
Figure 7C:
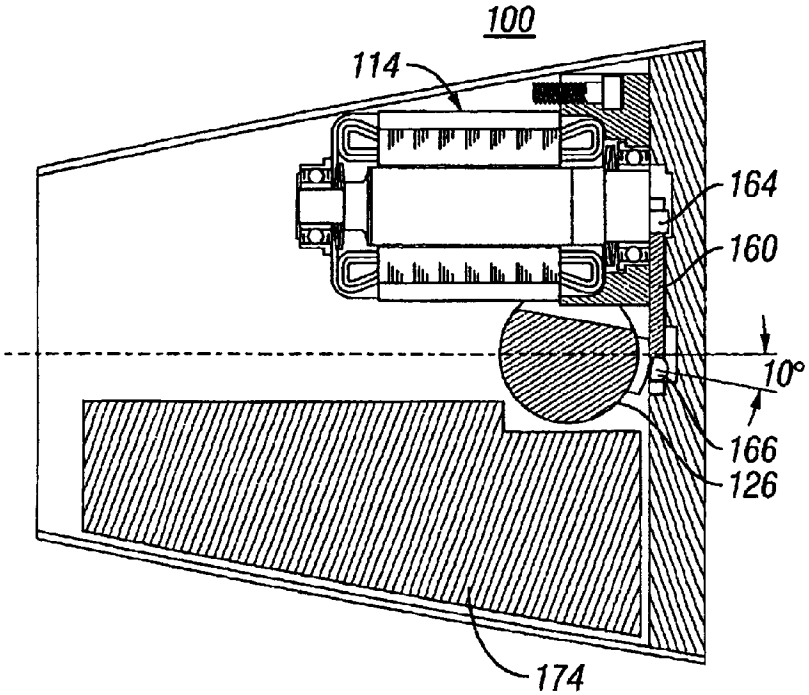

The views of FIGS. 7A–7C are side sectional views of the motor compartment; the views of FIGS. 8A–8C are transverse end views of the same assembly.

FIGS. 7A and 8A show the motor 114 and rotor 116 at the zero angular displacement, or rest, position. The fin shaft 126 is also at a zero displacement position, for which the associated fins would be positioned in line with the projectile for a straight, non-rolling flight. As shown for the example of FIGS. 7A and 8A, the diameter of the link arm pins is 0.13 inches. The link arm 116 has a width of 0.25 inches. The circle containing the arc of travel of the motor shaft pin 164 has a diameter of 0.20 inches. The distance between the centers of the ball pin 166 and the fin shaft 126 is 0.49 inches. The distance between the two ball pin connectors 164 and 166 is 0.80 inches. The diameter of the fin shaft 126 at the bearings 129 is 0.75 inches.

FIGS. 7B and 8B are views corresponding to FIGS. 7A and 8A but with the rotor shaft 116 rotated through its maximum angular displacement of 60°, resulting in an angular displacement of the fin shaft 126 of 10°. The resulting movement of the link arm pins along the direction of the link arm 116 is 0.09 inches. The same distances and angular displacements apply in the views of FIGS. 7C and 8C, except that the displacement is in the opposite direction. Since the dimensions of displacement are the same as in the first embodiment, the description regarding reduction ratio and variable reduction ratio are applicable to the second embodiment.

Although there have been described hereinabove various specific arrangements of a GUN-LAUNCHED ROLLING PROJECTILE ACTUATOR in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. An actuator system for controlling the position of an opposed pair of aerodynamic control fins of a gun-launched projectile, the projectile having a transverse shaft extending between said opposed pair of fins, said system comprising:

an electric motor having an output shaft coupled to drive said control fin shaft;

a coupling arrangement for coupling the motor shaft to the fin shaft with a variable reduction ratio of motor shaft rotation to fin shaft rotation;

a source of electric power for the motor; and means for limiting rotation of the motor shaft to less than 180 degrees.

2. The system of claim 1 wherein said rotation limiting means is effective to limit the rotation of said control fin shaft to less than 180 degrees.

3. The system of claim 1 wherein said variable reduction ratio is a maximum at maximum deflection of said aerodynamic control fins.

4. The system of claim 1 wherein the torque applied through said coupling arrangement from the motor shaft to the fin shaft is variable with rotation of the motor shaft.

5. The system of claim 4 wherein the torque applied by the motor shaft to the fin shaft is greatest at a maximum deflection of said control fins.

6. The system of claim 1 wherein said coupling arrangement comprises a pin-and-crank configuration for developing leverage in the rotation of said motor shaft and an eccentric slotted coupling member mounted on the fin shaft, the pin being received within the slot of said slotted coupling in a sliding relationship.

7. The system of claim 6 wherein said pin comprises a ball mounted on the end of the motor shaft.

8. The system of claim 1 wherein said motor is axially aligned along the central longitudinal axis of said projectile.

9. The system of claim 1 wherein said motor is mounted in an offset position from the projectile longitudinal axis and aligned parallel thereto.

10. The system of claim 7 wherein said motor shaft pin is constrained to slide along said slot in a radial direction with deflection of said control fins.

11. The system of claim 10 wherein said pin moves toward and away from said control fin shaft as said shaft is rotated between minium and maximum deflection of said control fins.

12. The system of claim 6 wherein said control fin shaft coupling member is axially displaced from the output end of the motor shaft.

13. The system of claim 1 wherein said control fin shaft is oriented perpendicularly to said motor shaft.

14. The system of claim 1 wherein said motor is mounted within a space within the projectile housing which is laterally displaced from the projectile axis.

15. The system of claim 14 wherein said coupling arrangement includes a link extending transversely of the missile axis between the motor shaft and the coupling member which is mounted on said fin shaft.

16. The system of claim 6 wherein the pin of said motor shaft comprises a ball mounted to the end of said shaft in a radially displaced position to develop eccentric motion of said ball.

17. The system of claim 16 wherein said fin shaft has a ball mounted at the outer surface thereof and wherein said link is coupled to extend between the motor shaft ball and the control fin shaft ball.

18. The system of claim 14 wherein said fin shaft is provided with a cut-out region to avoid interference with said motor housing.

* * * * *